United States Patent [19]

Cunningham

[11] 4,390,095

[45] Jun. 28, 1983

[54] LAY FLAT TUBE MULTI-PACKAGING DEVICE FOR CONTAINERS

[75] Inventor: Ernest R. Cunningham, Libertyville, Ill.

[73] Assignee: Grip-Pak, Inc., St. Louis, Mo.

[21] Appl. No.: 236,779

[22] Filed: Feb. 23, 1981

Related U.S. Application Data

[63] Continuation-in-part of Ser. No. 207,269, Nov. 17, 1980, abandoned.

[51] Int. Cl.[3] ..... B65D 71/02; B65D 63/10; B65D 85/62

[52] U.S. Cl. ..... 206/150; 206/428; 206/805; 229/52 B

[58] Field of Search ..... 206/150, 149, 428, 427, 206/805; 229/52 B

[56] References Cited

U.S. PATENT DOCUMENTS

| | | | |
|---|---|---|---|
| 2,022,557 | 11/1935 | Caggiano | 206/499 |
| 3,460,863 | 8/1969 | Schaich | 206/427 |
| 3,721,337 | 3/1973 | Braun et al. | 206/150 |

FOREIGN PATENT DOCUMENTS

| | | | |
|---|---|---|---|
| 905110 | 2/1954 | Fed. Rep. of Germany | 206/150 |

*Primary Examiner*—William T. Dixson, Jr.
*Attorney, Agent, or Firm*—Michael Kovac

[57] ABSTRACT

A lay flat tube plastic multi-packaging device for containers is disclosed as having upper and lower band segments with the upper and lower band segments being configured and arranged to engage upper and lower areas of the containers through elastic gripping engagement thereof for carrying said containers.

14 Claims, 15 Drawing Figures

LAY FLAT TUBE MULTI-PACKAGING DEVICE FOR CONTAINERS

SUMMARY OF THE INVENTION

This is a continuation-in-part of Ser. No. 207,269 filed Nov. 17, 1980, now abandoned.

One of the fastest growing areas of soft drink beverage containers is the 2 liter all plastic container. The market for 2 liter containers, and to a lesser degree, 1 liter containers, has literally exploded overnight from a zero market share in the late 1970's to approximately 16% of the total soft drink beverage container market in 1980. Projections through 1984 show the 1 liter and 2 liter all plastic containers garnering approximately 20% of the USA market. *BEVERAGE WORLD* ; (June 1980).

Multi-packaging of 1 liter and 2 liter all plastic containers in packages of at least two containers has not been successful since no widely acceptable multi-packaging device has been developed. There are, of course, the well known cardboard sleeve and basket style packages developed by such companies as Mead Packaging, Olinkraft Corporation, and others; however, the high cost of such multi-packaging techniques for the large 1 liter and 2 liter plastic beverage containers provides a limited market for such multi-packaging techniques. Another approach, which has been commercially proposed by Illinois Tool Works, Inc., is a stretch plastic tube which elastically embraces the sidewalls of the containers, while a separate injection molded plastic handle grips the necks of bottles to form a handle for carrying same. The market acceptance for this multi-packaging technique is also expected to be low due to the high cost of two separate multi-packaging elements, as well as packaging machine complexity for the separate assembly of the plastic tube and clip to beverage containers.

In applicant's own prior U.S. Pat. No. 3,812,962, a one-piece multi-packaging device for large beverage containers has been proposed. The device disclosed in this patent comprises a one-piece multi-packaging device having a stretch mounted wrap-around skirt for engaging the containers, a covering top, and an integral upstanding multi-thickness handle for transporting the containers. While this device is very unique and works quite well, it is principally designed for 3-pack multi-packages; however, a 3-pack for 2 liter bottles is too heavy for most consumers. Therefore, this design also has limited use where 2-pack multi-package devices for 2 liter bottles and the like are required.

Accordingly, it is the principal object of the present invention to provide a new and improved multi-package device for large beverage containers which overcomes the aforementioned deficiencies of prior art designs.

Other objects of the present invention are to provide a multi-packaging device for large beverage bottles and other containers of various sizes and shapes which has the following advantages: simplicity in design and construction, unique in function and operation, extremely economical in cost, easy to assemble to containers, capable of in-plant manufacture in the plants of soft drink bottlers and the like, requires simple and inexpensive manufacturing and/or assembly equipment, and is otherwise well adapted for the intended purposes.

These and other objects and advantages are attained by a multi-packaging device for beverage containers which includes a flattened band of stretchable and elastic plastic material having an integrally continuous wall with upper and lower band segments, the upper band segment having spaced openings therein for receiving the upper end of said containers, and the lower band segment being provided for engaging the bottom ends of said containers, the upper and lower band segments being stretched in elastic gripping engagement with the upper and bottom ends and sidewalls of said containers.

DESCRIPTION OF THE PREFERRED EMBODIMENTS

Figure 13:
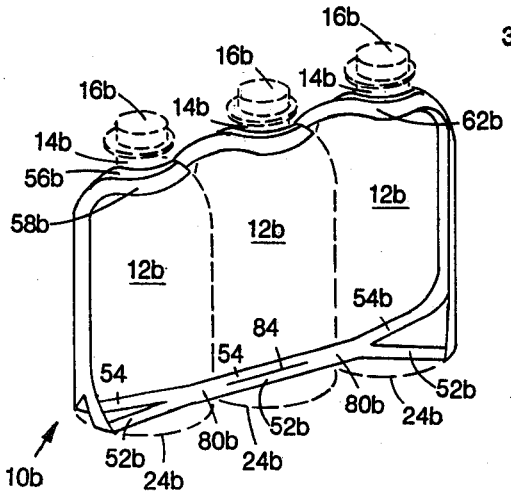
FIG. 13 is a perspective view, reduced in size, of yet another modified form of plastic multi-packaging device shown assembled to three beverage containers, illustrated by phantom lines.
Figure 14:
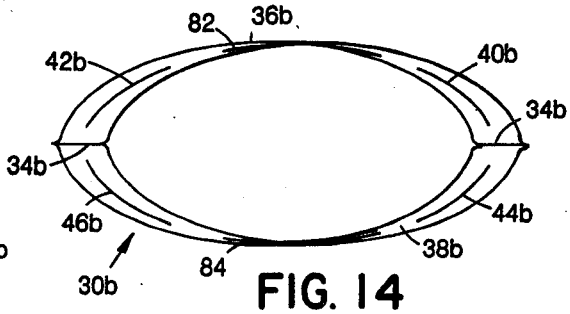
FIG. 14 is a side elevational view illustrating the modified form of plastic multi-packaging device shown in FIG. 13 in an initially opened position prior to assembly to beverage containers.
Figure 15:
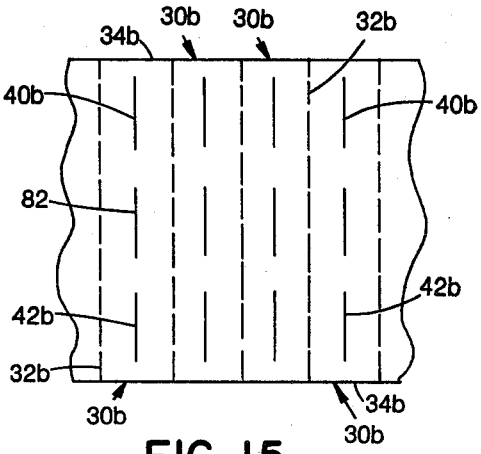
FIG. 15 is a fragmentary top plan view of a plurality of adjacent, frangibly connected plastic multi-packaging devices of the type shown in FIGS. 13–14 which are formed from lay flat plastic tubing.

This invention is principally directed to lay flat plastic tube multi-packaging devices which are assembled to large beverage containers; however, it will be understood that the multi-packaging device may be used for various types of bottles, containers and other articles as well. It will also be understood that while the container package shown in FIGS. 1–12 of the drawings is a two-pack configuration, the invention contemplates the use of three-packs, such as for three 1 liter beverage containers, as shown in FIGS. 13–15, where the weight of the container package does not exceed consumer preferences.

The general description and operation of the methods and assembly machine principles for assembling the lay flat tube multi-packaging devices will be discussed herein; however, for a detailed description, reference is made to my copending patent application Ser. No. 223,223 filed Jan. 7, 1981.

Attention is now directed to the first embodiment of the invention shown in FIGS. 1–9 of the drawings.

Figure 1:
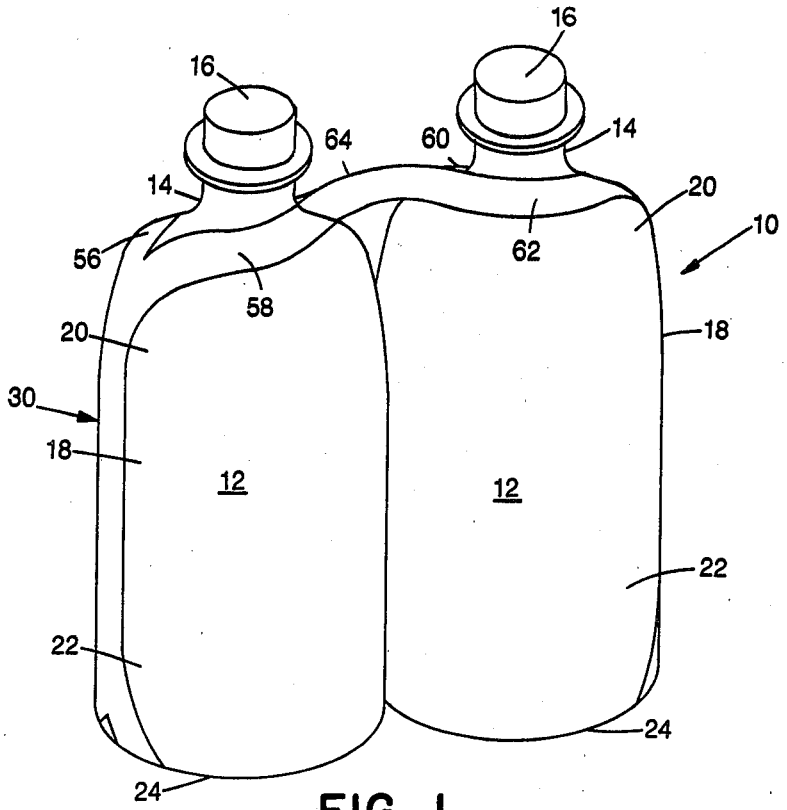
FIG. 1 is a perspective view of a container package including two beverages containers and a lay flat tube multi-packaging device which is constructed in accordance with the teachings of the present invention.
Figure 2:
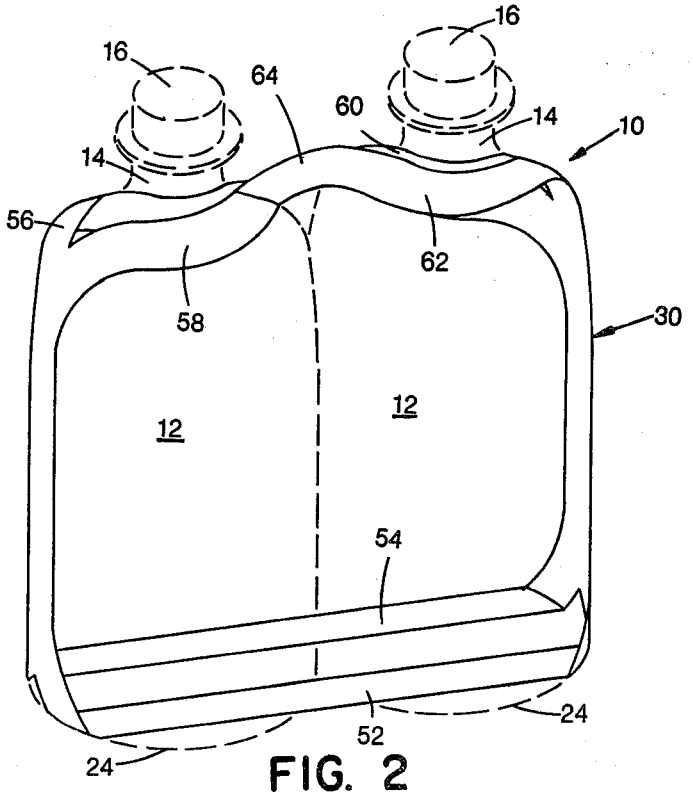
FIG. 2 is a perspective view of the container package shown in FIG. 1 with the two beverage containers depicted in phantom lines to specifically illustrate the manner in which the plastic multi-packaging device elastically embraces and conforms to the shape of beverage containers.
Figure 3:
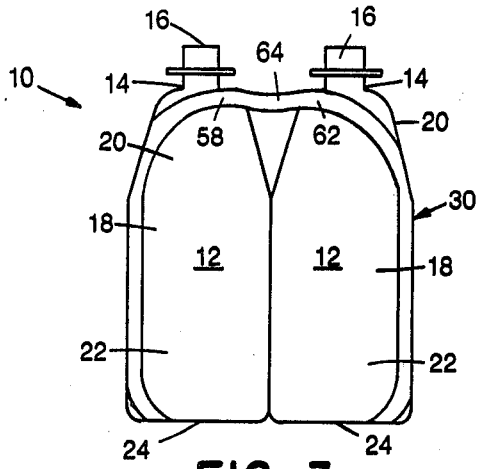
FIG. 3 is a side elevational view of the container package shown in FIG. 1 on a smaller scale.
Figure 4:
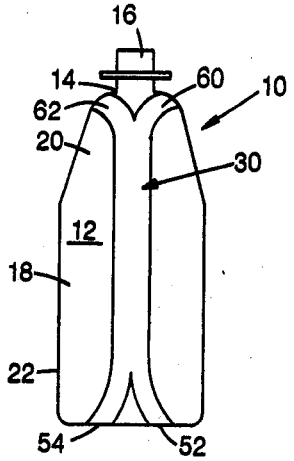
FIG. 4 is an end elevational view of the container package shown in FIG. 1 on the same scale size as FIG. 3.
Figure 5:
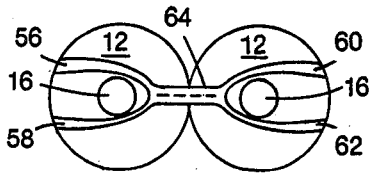
FIG. 5 is a top plan view of the container package shown in FIG. 1 on the same scale as FIGS. 3 and 4.

The container package 10 shown in FIGS. 1–6 of the drawings include two large beverage containers 12, 12 each having an upper end terminating in a reduced neck portion 14 and a screw threaded cap 16 which is threadably associated to screw threads formed on the terminal portion of the reduced neck portion 14 as is well known. Each of the containers further includes a body or sidewall portion 18 which is configured in any manner desired, such as by the tapered upper body or sidewall portion 20 which extends from the reduced neck portion 14 to the cylindrically configured lower body or sidewall portion 22, as best seen in FIGS. 3–4. Each beverage container 12 terminates at its lower end in a bottom or base 24.

Some of the current plastic beverage container designs comprise a two-piece construction wherein a smaller cylindrical cup or base receives a semi-spherically shaped preform design at the lower end thereof, while there are other designs that are of one-piece construction and employ slotted designs in the area of the juncture between the lower body or sidewall of the container and the bottom or base, in order to reinforce same. With these and other designs (whether plastic, plastic coated glass, or otherwise), the lay flat tube multi-packaging device of the present invention is capable of conforming to the designed shape thereof in order to provide a functional multi-package.

Figure 7:
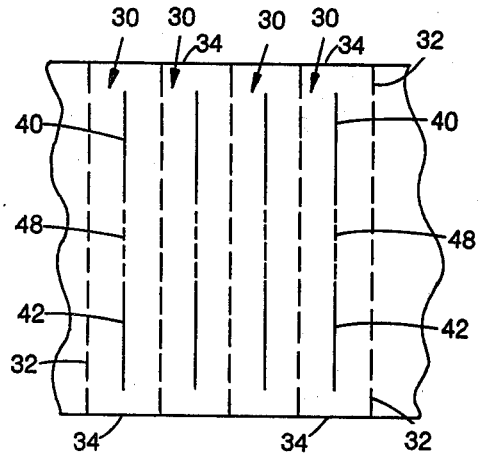
FIG. 7 is a fragmentary top plan view of lay flat tube plastic tubing, illustrating the manner in which a plurality of plastic multi-packaging devices of the present invention are formed and attached to one another.

As best seen in FIG. 7, the lay flat plastic tube multi-packaging device 30 of the present invention is formed in a continuous pattern as individual multi-packaging devices 30 as shown in FIG. 7 from a roll of seamless lay flat blown film. Each individual multi-packaging device 30 is formed as a uniform width band and is separated from adjacent multi-packaging devices 30 along the dotted lines 32, either by cutting or tearing therefrom, in the manufacturing and/or assembly process.

Figure 8:
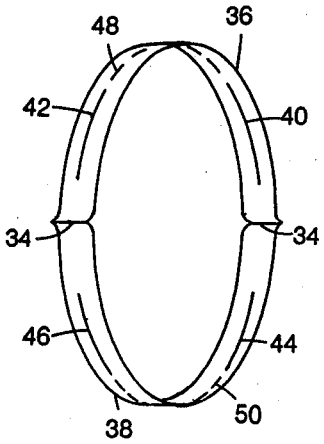
FIG. 8 is a side elevational view depicting initial opening of a lay flat tube plastic multi-packaging device to form the upper and lower band segments which are configured and arranged to engage upper and lower areas of the beverage containers, as will be explained in detail herein.

Note from FIG. 8 that what results is a lay flat plastic tube multi-packaging device 30 having an integrally continuous wall with opposed folded ends 34,34 defining upper and lower band segments 36,38 respectively for engaging upper and lower areas of the containers 12,12, as will be described.

In order to elastically embrace and grip the containers 12, 12 as shown in FIGS. 1 and 2, each lay flat plastic tube multi-packaging device 30 is provided, along the longitudinal centerline thereof, with two spaced cuts or slits 40, 42 in the upper band segment 36 and a symmetrical pattern of spaced cuts or slits 44, 46 in the lower band segment 38. The spacing of the symmetrical pattern of cuts or slits 40, 42 and 44, 46 is approximately equal to or slightly greater than the minimum center distance between two containers 12, 12 or is approximately equal to one container diameter. It is to be noted that the cuts or slits 40, 42 and 44, 46 are made completely through both layers of the seamless layflat blown film.

Along the same longitudinal centerline of each multi-packaging band or device 30, perforations 48, 50 respectively are formed between the cuts or slits 40, 42 in the upper band segment 36 and also between the cuts or slits 44, 46 in the lower band segment 38. The total minimum cut/perforation length required is dependent on the overall circumference of two containers 12, 12 in contact with one another. The combined cut/perforation length should be only slightly more than one-half the outside circumferential dimension of two contacting containers 12, 12 at their major diameter (expressed arithmetically as $\pi D/2+$Diameter) in order to prevent tearing of uncut and unperforated material during assembly of the package.

During assembly to two containers 12, 12, the lower band segment 38 of the multi-packaging device 30 is brought down over the reduced necks 14, 14 of the two containers. While this takes place, the upper band segment 36 is supported in a manner that can apply tension only along the major dimension of the band loop. The lower band segment 38 is progressively forced down over the reduced necks 14, 14, the tapered upper body or sidewall portions 20, 20 and the lower body or sidewall portions 22, 22 of the two containers 12, 12. It is this action which applies transverse forces to the perforations 50 in the lower band segment 38 causing them to fracture and thus creating a single long slit comprising the cuts or slits 44, 46 and the now broken perforations 50. The minimum cut/perforation length of the slits 44, 46 and the perforations ($\pi D/2+$Diameter) allows the now single long slit to pass freely down each side of the containers 12, 12 when the multi-packaging device or band 30 is thus elongated.

Figure 6:
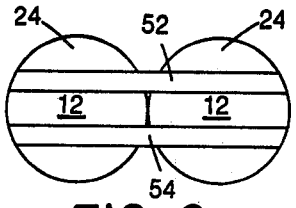
FIG. 6 is a bottom plan view of the container package shown in FIG. 1 on the same scale as FIGS. 3–5.

The lower band segment 38 is thereby formed into a pair of spaced band segment straps 52, 54 which are designed to engage the bottoms or bases 24, 24 of the two containers, as best seen in FIGS. 2, 4 and 6. During the assembly process, when the spaced band segment straps 52, 54 reach the curved portion in the area of the juncture between the lower body or sidewall portion 22 and the bottoms or bases 24 of the containers 12, 12, the straps 52, 54 tend to move toward the centerline of the containers 12, 12 because the juncture area of the containers introduces an angular force.

In determining the combined length of the cut/perforation in the lower band segment 38, the spaced band segments 52, 54 should not extend up the sidewall of the containers more than one-half a diameter (D/2) upward from the bottoms or bases 24, 24. The juncture point where the spaced band segments 52, 54 becomes a single band segment 38 is useful in bringing the spaced band segments 52, 54 toward each other as they are stretched below the plane of the bottoms or bases 24, 24, as described below.

While the band segment straps 52, 54 are brought into engagement with the bottoms or bases 24, 24 of the two containers 12, 12, the upper band segment 36 is then moved to a position where the cuts or slits 40, 42 embrace the reduced neck portions 14, 14 of the containers. Thus, opening or slit 42 forms spaced material portions 56, 58, while the opening or slit 42 forms spaced material portions 60, 62 which embrace the reduced neck portions 14, 14 of the containers 12, 12, and perhaps also part of the tapered upper body or sidewall portions 20, depending on the combined length of the cut/perforation.

When completely assembled to two containers 12, 12, the lay flat plastic tube multi-packaging band or device 30, of the FIGS. 1–9 embodiment, as described above, extends in vertical circumferential engagement and is stretched in elastic gripping engagement with the reduced neck portions 14, 14, the sidewalls 18, 18 and the bottoms or bases 24, 24 of the two containers 12, 12 as shown in FIGS. 1–4. The stretching action of the multi-packaging band or device 30 causes it to form fit to the curvature of the containers 12, 12 and adhere to them well. The flexible multi-packaging band or device 30 also fits closely to the surface of the containers and excludes air, thus greatly improving container retention. When both the multi-packaging device or band 30 and the containers 12, 12 are plastic, there is a tendency of some plastics to adhere to one another, which is also useful for improving the rigidity of the container package 10. Further, it has been noted that with plastic beverage containers, the elastomeric embracing characteristic of the multi-packaging device or band 30 creates a small flat area between the contacting surfaces of the two containers 12, 12 along the major diameter thereof due to elastomeric relaxation of the plastic beverage containers 12, 12 that are placed under constant band stress. This slight flat area of contact between the two containers 12, 12 also acts to prevent rotation of the two containers.

In the assembled container package 10, the area of the upper band segment 36 between the two containers 12, 12, which contains the perforations 48, provides a very soft flexible integral handle 64 for carrying the containers 12, 12. The area of juncture between the reduced neck portions 14, 14 and the upper tapered body or sidewall portions 20, 20 causes a slight uneven tension on the upper band segment, and the result is that the edges of the handle 64, particularly when thin guage material is used, tend to fold under forming a soft feel for the user in lifting the containers 12, 12 by the handle 64.

The perforations 48 in the handle 64 of the upper band segment 36 serve a useful purpose in the package design. These perforations 48 can be ruptured by hand at the point of end use by the consumer, thus providing a convenient method for removing the bottles. When a manual separating force is applied across the perforations 48, the upper band segment 36 is split in two like the lower band segment 38, thus allowing the individual split bands to be slid down along the sidewalls 18, 18 of the containers 12, 12 and thereby releasing tension in the multi-packaging band or device 30.

For further improving the easy open action by a consumer, a cut can be made in the perforations 48 midway between the reduced necks 14, 14 for inserting two fingers (one on each hand) in order to sever the perforations 48 from the center of the handle 64.

Package function is unaffected by the perforations 48 because they are made in a direction that is parallel to the principal tensile forces. The perforations 48 are fractured only when a deliberate side force is applied, either by the assembly machine in forming the package or by the consumer when the two containers 12, 12 are removed from the two-pack.

An important feature of the present invention is provided by the divided sling action of the spaced band segments 52, 54 as they engage the bottoms or bases 24, 24 and a portion of the lower body or sidewall 22, together with the cooperative interaction of the spaced band segments 52, 54 and the spaced material portions 56, 58 and 60, 62 in their stretched and elastomeric relationship to one another. Container retention during lifting and transporting the package is improved by this interaction since the weight of the containers is shifted to the divided sling action of the spaced band segments 52, 54, through the spaced material portions 56, 58 and 60, 62 of the upper band segment 36, as the handle 64 is gripped by a user and the container package is lifted. Thus, the weight of the containers 12, 12 is lifted by the divided sling action of the spaced band segments 52, 54 in cooperative interaction with the spaced material portions 56, 58 and 60, 62 of the upper band segment 36, instead of relying on a lifting force dependent on contact with the reduced neck portions 14, 14, as so many prior art devices have done.

Figure 9:
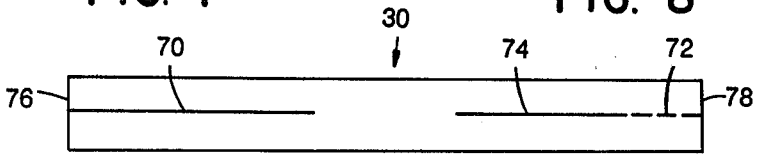
FIG. 9 is a top plan view of a lay flat plastic tube which is formed by an alternative manufacturing technique.

In lieu of a symmetrical pattern of cuts or slits in the upper and lower band segments 36, 38, there is shown in FIG. 9 an alternative manufacturing technique in which the layflat tubing is cut at 70 all the way through both layers at one end, and at the other end is perforated at 72 for a short distance thereof and is cut at 74 from adjacent the perforations 72 all the way through both layers. When the thus formed layflat tube multi-packaging device 30 is rotated counterclockwise 90, from the FIG. 9 position, to a position similar to FIG. 8 where the perforations 72, correspond with with perforations 49, and the upper cuts or slits 40, 42 correspond with the cut 74 in both layers of the tubing, the cut 70 also corresponds with the combined length of the cuts or slits 44, 46 and the broken perforations 50, thus enabling the tubing to be assembled to the containers 12, 12, as previously described, without the need to break the perforations 50.

This alternative manufacturing technique provides several important advantages. By forming the lay flat tube multi-packaging device 30 as shown in FIG. 9 and then rotating same counterclockwise 90 from the FIG. 9 to the FIG. 8 position, the lay flat tube multi-packaging device 30 of the FIG. 9 embodiment has a long slit or cut 70 only in the lower band segment 38, without any perforations, and thus it is unnecessary to break the perforations with the containers 12, 12 during assembly, as previously described. This greatly simplifies the manufacturing and assembly processes. At the same time, it provides the same functional attributes of the lay flat tube multi-packaging device 30 when assembled to containers 12, 12.

In the FIG. 9 illustration, the opposed ends 76, 78 do not define or segregate the upper and lower band segments since the multi-packaging device 30 is rotated 90 prior to assembly to containers, and when thus rotated, upper and lower band segments similar to the FIGS. 1–8 embodiment are thereby provided.

Figure 10:
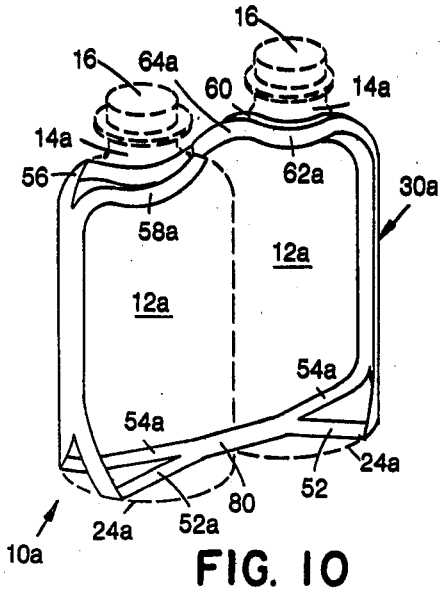
FIG. 10 is a perspective view, reduced in size, of a modified form of plastic multi-packaging device shown assembled to two beverage containers illustrated by phantom lines.
Figure 11:
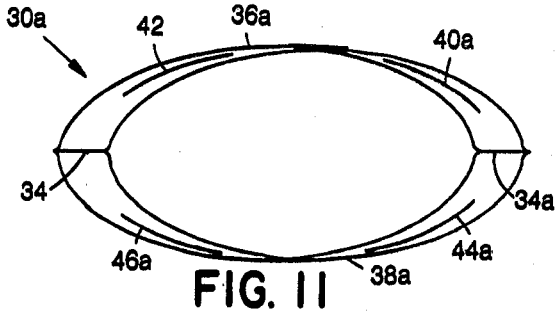
FIG. 11 is a side elevational view illustrating the modified form of plastic multi-packaging device shown in FIG. 10 in an initially opened position prior to assembly to beverage containers.
Figure 12:
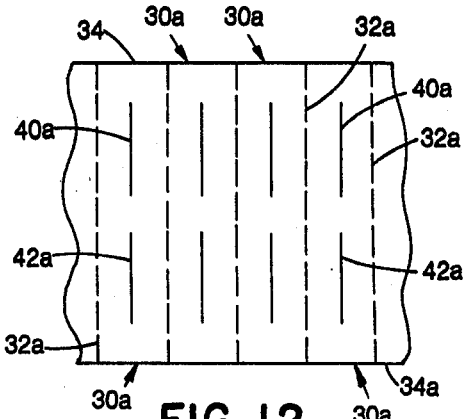
FIG. 12 is a fragmentary top plan view of a plurality of adjacent, frangibly connected plastic multi-packaging devices of the type shown in FIGS. 10–11 which are formed from lay flat plastic tubing.

Reference is now made to a further embodiment of the invention shown in FIGS. 10–12 of the drawings. The same reference numerals have been used to designate like parts with the FIGS. 1–9 embodiments except that the suffix "a" has been used to distinquish from the FIGS. 1–9 embodiments.

It will be seen that the container package 10*a* in FIGS. 10–12 is similar to the container package 10 in the FIGS. 1–9 embodiment, except that the spaced band segment straps 52*a*, 54*a* of the FIGS. 10–12 embodiment are joined to each other at 80 generally in the area between the two bottles or containers 12*a*, 12*a*. This is achieved by forming the lay flat tube multi-packaging device 30*a* as in the FIGS. 1–9 embodiment, but instead of completely separating the spaced band segment straps 52*a*, 54*a* during the assembly process, the lay flat tube multi-packaging device 30*a* is stretched and applied over the outside of the containers 12*a*, 12*a*, thereby leaving the integral section 80 between pairs of spaced band segment straps 52*a*, 54*a*. Generally, the assembly takes place by opening the slits 40*a*, 42*a* in the upper band segment 36*a* and positioning same over the reduced necks 14*a*, 14*a* of the bottles 12*a*, 12*a*, while the lay flat tube multi-packaging device 30*a* is stretched to allow the spaced band segment straps 52*a*, 54*a* to be moved over one side of the containers 12*a*, 12*a* to a position below the bottoms 24*a*, 24*a* of the containers 12*a*, 12*a*. Thereafter, the straps 52*a*, 54*a* on each side of the integral section 80, are slightly spread apart to assume the position shown in FIG. 10.

It has been discovered that the integral section 80 works in conjunction with the straps 52*a*, 54*a* to prevent movement of the straps 52*a*, 54*a* relative to the containers 12*a*, 12*a*. As a result of the pressurized interior of the beverage containers 12*a*, 12*a*, it is sometimes difficult to prevent rotation of the containers 12*a*, 12*a*, unless tightly compressed by the lay flat tube multi-packaging device. Since the contact between the containers 12*a*, 12*a* is generally along a curved surface, rotation or movement of one container causes the same or opposite rotation or movement of the second container. The tendency is to cause the spaced band segment straps to separate, thereby encouraging the undesired separation of the containers from the lay flat tube multi-packaging device. However, with the integral section 80 of the FIGS. 10–12 embodiment, since each pair of straps 52*a*, 54*a* is associated with a particular container 12*a*, the movement of one or both containers 12*a*, 12*a* generally affects only the straps 52*a*, 54*a* associated with the moving container. Thus, each pair of straps 52*a*, 54*a* are generally independently operable relative to one another. In addition, it has been found that with the FIGS. 10–12 embodiment, the lay flat tube multi-packaging device 30*a* need not necessarily place the containers 12*a*, 12*a* under compression, since the divided sling action from each pair of spaced band segments 52*a*, 54*a* for each container 12*a* allows more freedom of movement of the containers 12*a*, 12*a*, without causing undesired separation of the lay flat tube multi-packaging device 10*a* from the containers 12*a*, 12*a*. It is important; however, that the lay flat tube multi-packaging device 10*a* be stretched into elastic gripping engagement with the containers 12*a*, 12*a*, in order to provide all of the functions and attributes heretofore mentioned.

In FIGS. 11–12, it can be seen how the symmetrical pattern of slits in the upper and lower band segments 36*a*, 38*a* are provided. The slits 40*a*, 42*a* in the upper band segment 36*a* correspond with the symmetrical pattern of slits 44*a*, 46*a* in the lower band segment 38*a*. It will be further appreciated that with this embodiment, the manufacturing process is facilitated since it requires no rotation as in the alternative manufacturing technique illustrated by FIG. 9, and assembly process is also relatively uncomplicated since it is a stretch over and apply over one side of the containers, rather than separating portions of the lay flat tube multi-packaging device over opposite sides of the containers.

In the embodiment of the invention shown in FIGS. 13–15, the same reference numerals have been used to designate like parts with the previous embodiments, except that the suffix "b" has been used to distinquish from the previous embodiments.

The FIGS. 13–15 embodiment show a 3-pack design, such as for 1 liter containers and the like. Essentially, the only difference from the FIGS. 10–12 embodiment is the addition of another pair of symmetrical slits 82, 84 in the upper and lower band segments 36*b*, 38*b* respectively, as seen in FIGS. 14–15. This enables a third container 12*b* to be included in the container package 10*b*, with the slit 82 opening to receive the reduced neck 14*b* of the third container , while the slit 84 in the lower band segment remains closed, thereby forming a double width band, since the band segment straps 52*b*, 54*b* are not separated as they are with the two outside containers in the container package 10*b*. This design has all of the advantages of the FIGS. 10–12 embodiment for the two outside containers, and the intermediate container has the underlying double width band section, which will not cause movement of the pairs of straps 52*b*, 54*b* relative to one another. This will assist in retaining all of the containers in the 3-pack container package 10*b* shown.

In order to further restrain movement of the spaced band segment straps in any of the aforementioned embodiments, it is possible to tack or adhesively bond the spaced band segment straps to the bottoms of the containers, as will be apparent. Depending on the configuration and elastic embracing characteristics of the lay flat tube multi-packaging device, this may or may not be necessary, for the reasons previously given.

The band width and/or thickness of the layflat tubing can be selected in proportion to the size and weight variation of individual containers. The multi-packaging bands or devices in the various embodiments can be designed, as will be apparent, to be adaptable to a wide variety of material variations without significant effect on package integrity. The percent elongation that is placed on the multi-packaging bands or devices during assembly is also variable, and can be maximized to reduce the amount of material that is used in each package, dependent on the elastomeric properties of the material used in preparing layflat tubing. Generally, polyethylene is the preferred material since it is easily produced by blown film techniques and has excellent elongation characteristics.

From the foregoing, it will now be appreciated that the present invention provides an exceptionally unique, economical and functional multi-packaging device for beverage containers and the like, particularly the large plastic beverage containers which are being used extensively today.

What is claimed is:

1. A one-piece generally scrapless multi-packaging device for a plurality of containers or the like each having upper ends, bottom ends and sidewalls, said multi-packaging device including a flattened band of stretchable and elastic material which is of smaller predetermined measurement than the vertical circumferential dimension of a plurality of such containers, such flattened band having an integrally continuous wall with upper and lower band segments, the upper band segment having spaced openings therein for receiving the upper end of said containers and the lower band segment being provided for engaging the bottom ends of said containers, said flattened band being stretched from its smaller predetermined measurement into elastic gripping engagement with the upper and and bottom ends and sidewalls of said containers along the vertical circumferential dimension thereof to form a container package for gripping and transporting the containers.

2. The multi-packaging device as defined in claim 1 wherein the openings in the upper band segment are spaced from each other by a distance generally equal to the minimum center distance between the containers.

3. The multi-packaging device as defined in claim 1 wherein the area of the upper band segment between the spaced openings comprises handle means for carrying the containers.

4. The multi-packaging device as defined in claim 3 wherein the area of the upper band segment between the spaced openings is also perforated between said openings to facilitate tearing thereof to remove said multi-packaging device from said containers.

5. The multi-packaging device as defined in claim 4 wherein the minimum combined length of the openings and intermediate perforated area is at least equal to one-half of the outside circumferential dimension of said containers at their major diameter to prevent tearing of uncut and unperforated material during assembly of the multi-package device to said containers.

6. The multi-packaging device as defined in claim 1 wherein the lower band segment includes spaced band segment straps for engaging the bottom ends of said containers.

7. The multi-packaging device as defined in claim 6 wherein the spaced band segments are formed by elongated slit means formed in the lower band segment to create a divided sling action for said containers which elastically interacts with the material surrounding the spaced openings for lifting and transporting said containers.

8. The multi-packaging device as defined in claim 7 wherein the spaced band segments are integrally joined to each other in the general area between the containers to provide pairs of spaced band segment straps on each side of the integrally joined area, thereby creating divided slings from each pair of spaced band segment straps for each container.

9. The multi-packaging device as defined in claim 1 wherein the width of said flattened band of material defining said upper and lower band segments is substantially less than the diameter of said containers.

10. A multi-packaging device for a plurality of containers arranged in side by side relationship each having upper ends, bottom ends and sidewalls, comprising a lay flat tube multi-packaging device made from stretchable and elastic plastic material having a width substantially less than the major diameter of the containers, said lay flat tube multi-packaging device having upper and lower band segments, the upper band segment having spaced openings therein for receiving the upper ends of said containers, and the lower band segment including spaced band segment straps for engaging the bottom ends of said containers, said lay flat tube multi-packaging device being stretched into elastic gripping engagement with the upper ends, bottom ends and sidewalls of said containers, with the said spaced band segments engaging the bottom ends and lower sidewalls as a divided sling which elastically interacts with the material surrounding the spaced openings for lifting and transporting said containers.

11. The lay flat tube multi-packaging device as defined in claim 10 and including spaced openings in the lower band segment symmetrical to the spaced openings in the upper band segment, the spaced openings in the lower band segment defining pairs of spaced band segment straps for engaging the bottom end of each container.

12. A lay flat tube polyethylene multi-packaging device for bottles, comprising upper and lower band segments, at least the upper band segment having openings therein for receiving upper ends of said bottles, and the lower band segment having spaced band segments which engage and lift the bottles as a divided sling and which also elastically interacts with the material surrounding the spaced openings in the upper band segment for lifting and transporting said containers.

13. The multi-packaging device as defined in claim 12 wherein the lower band segment includes spaced openings symmetrical with the spaced openings in the upper band segment which define pairs of spaced band segment straps for engaging the bottom end of each container.

14. The multi-packaging device as defined in claim 13 wherein the area of the upper band segment between the spaced openings comprises handle means for carrying the containers, and the area of the lower band segment between the spaced openings comprises an integrally joined area which separates the pairs of spaced band segment straps from each other.

* * * * *